US006672922B2

(12) United States Patent
Shirakawa et al.

(10) Patent No.: US 6,672,922 B2
(45) Date of Patent: Jan. 6, 2004

(54) COMPOSITE SUBSTRATE PREPARING METHOD, COMPOSITE SUBSTRATE, AND EL DEVICE

(75) Inventors: Yukihiko Shirakawa, Tokyo (JP); Taku Takeishi, Tokyo (JP)

(73) Assignee: TDK Corporation, Tokyo (JP)

( * ) Notice: Subject to any disclaimer, the term of this patent is extended or adjusted under 35 U.S.C. 154(b) by 319 days.

(21) Appl. No.: 09/866,697

(22) Filed: May 30, 2001

(65) Prior Publication Data

US 2002/0039000 A1 Apr. 4, 2002

(30) Foreign Application Priority Data

Aug. 18, 2000 (JP) ..... 2000-248630

(51) Int. Cl.[7] ..... H01J 9/02
(52) U.S. Cl. ..... 445/24; 419/8; 313/504
(58) Field of Search ..... 445/24, 25, 50, 445/51; 419/8; 313/503, 504, 506

(56) References Cited

FOREIGN PATENT DOCUMENTS

| | | |
|---|---|---|
| JP | 7-50197 | 2/1995 |
| JP | 7-44072 | 5/1995 |

OTHER PUBLICATIONS

Shosaku Tanaka, "Recent Development of Inorganic and Organic EL Display", 1998, pp. 1–10. No month.

X. Wu, "Multicolor Thin–Film Ceramic Hybrid EL Displays", International Display Workshop (IDW), 1997, pp. 593–596. No month.

*Primary Examiner*—Kenneth J. Ramsey
*Assistant Examiner*—Joseph Williams
(74) *Attorney, Agent, or Firm*—Oblon, Spivak, McClelland, Maier & Neustadt, P.C.

(57) ABSTRACT

The invention aims to provide a method for preparing a composite substrate which has minimized surface asperities on a dielectric layer, which are otherwise developed under the influence of an electrode layer, unevenness upon printing, and surface roughness inherent to thick-film dielectrics, which eliminates a need for a polishing step, which is easy to manufacture, and which is applicable to the fabrication of a thin-film light-emitting device of high display quality, as well as the resulting composite substrate and a thin-film EL device using the same. The object is attained by a method for preparing a composite substrate, comprising the steps of forming at least an electrode and a green dielectric layer according to a thick-film technique on an electrically insulating substrate, thereby providing a composite substrate precursor, smoothing the surface of the precursor by WIP process, and firing to complete the composite substrate, as well as the resulting composite substrate and a thin-film EL device using the same.

7 Claims, 1 Drawing Sheet

COMPOSITE SUBSTRATE PREPARING METHOD, COMPOSITE SUBSTRATE, AND EL DEVICE

BACKGROUND OF THE INVENTION

1. Field of the Invention

This invention relates to a composite substrate having a dielectric and an electrode, a method for preparing the same, and an electroluminescent (EL) device using the same.

2. Background Art

The phenomenon that a material emits light upon application of an electric field is known as electroluminescence (EL). Devices utilizing this phenomenon are on commercial use as backlight in liquid crystal displays (LCD) and watches.

The EL devices include dispersion type devices of the structure that a dispersion of a powder phosphor in an organic material or enamel is sandwiched between electrodes, and thin-film type devices in which a thin-film phosphor sandwiched between two electrodes and two insulating thin films is formed on an electrically insulating substrate. For each type, the drive modes include DC voltage drive mode and AC voltage drive mode. The dispersion type EL devices are known from the past and have the advantage of easy manufacture, but their use is limited because of a low luminance and a short lifetime. On the other hand, the thin-film type EL devices have markedly spread the practical range of EL device application by virtue of a high luminance and a long lifetime.

In prior art thin-film type EL devices, the predominant structure is such that blue sheet glass customarily used in liquid crystal displays and plasma display panels (PDP) is employed as the substrate, a transparent electrode of ITO or the like is used as the electrode in contact with the substrate, and the phosphor emits light which exits from the substrate side. Among phosphor materials, Mn-doped ZnS which emits yellowish orange light has been often used from the standpoints of ease of deposition and light emitting characteristics. The use of phosphor materials which emit light in the primaries of red, green and blue is essential to manufacture color displays. Engineers continued research on candidate phosphor materials such as Ce-doped SrS and Tm-doped ZnS for blue light emission, Sm-doped ZnS and Eu-doped CaS for red light emission, and Tb-doped ZnS and Ce-doped CaS for green light emission. However, problems of emission luminance, luminous efficiency and color purity remain outstanding until now, and none of these materials have reached the practical level.

High-temperature film deposition and high-temperature heat treatment following deposition are known to be promising as means for solving these problems. When such a process is employed, use of blue sheet glass as the substrate is unacceptable from the standpoint of heat resistance. Quartz substrates having heat resistance are under consideration, but not adequate in such applications requiring a large surface area as in displays because the quartz substrates are very expensive.

It was recently reported that a device was developed using an electrically insulating ceramic substrate as the substrate and a thick-film dielectric instead of a thin-film insulator under the phosphor, as disclosed in JP-A 7-50197 and JP-B 7-44072.

FIG. 2 illustrates the basic structure of this device. The EL device in FIG. 2 is structured such that a lower electrode 12, a thick-film dielectric layer 13, a light emitting layer 14, a thin-film insulator layer 15 and an upper electrode 16 are successively formed on a substrate 11 of ceramic or similar material. Since the light emitted by the phosphor exits from the upper side of the EL structure opposite to the substrate as opposed to the prior art structure, two electrodes are provided on upper and lower sides of the EL structure.

In this device, the thick-film dielectric has a thickness of several tens of microns which is about several ten to several thousand times the thickness of the thin-film insulator. This offers advantages including a minimized chance of breakdown caused by pinholes or the like, high reliability, and high manufacturing yields.

Use of the thick dielectric causes a voltage drop across the phosphor layer which is overcome by using a high-permittivity material as the dielectric layer. Use of the ceramic substrate and the thick-film dielectric permits a higher temperature for heat treatment. As a result, it becomes possible to deposit a light emitting material having high light-emitting characteristics, which was impossible in the prior art because of inclusion of crystal defects.

However, the light emitting layer formed on the thick-film dielectric layer has a thickness of several hundreds of nanometers which is about 1/100 of that of the thick-film dielectric layer. This requires that the surface of the thick-film dielectric layer be smooth to a level below the thickness of the light emitting layer although a conventional thick-film process is difficult to form a dielectric layer having a fully smooth surface.

If the surface of the dielectric layer is not smooth, it is impossible to uniformly form a light emitting layer thereon, and/or a delamination phenomenon occurs between the dielectric layer and the light emitting layer, which can cause a substantial degradation of display quality. Therefore, the prior art technology requires smoothing operations of removing large asperities by polishing and removing fine asperities by a sol-gel process.

However, it is technically difficult to polish large surface area substrates for display and other applications. The sol-gel process cannot accommodate for large asperities when used alone. Additionally, an increased cost of stock material and an increased number of steps involved are undesirable.

SUMMARY OF THE INVENTION

An object of the invention is to provide a method for preparing a composite substrate which has minimized surface asperities on a dielectric layer, which are otherwise developed under the influence of an electrode layer and a ceramic substrate, which eliminates a need for polishing step, which is easy to manufacture, and which is applicable to the fabrication of a thin-film light-emitting device of high display quality, as well as the resulting composite substrate and a thin-film EL device using the same.

The above object is attained by the present invention as constructed below.

(1) A method for preparing a composite substrate, comprising the steps of:

forming at least an electrode and a green dielectric layer according to a thick-film technique on an electrically insulating substrate, thereby providing a composite substrate precursor, smoothing the surface of the precursor by WIP process, and firing to complete the composite substrate.

(2) The method of (1) wherein the WIP process is effected at a temperature which is not lower than 40° C. or the glass transition temperature (Tg) of a binder in said green dielectric layer.

(3) The method of (1) wherein said green dielectric layer uses a thermoplastic resin as a binder.

(4) The method of (1) wherein during the heat compression step, a vacuum package is used to avoid contact of the composite substrate precursor with a pressure transmitting fluid, and a resin film is interposed between the vacuum package and the green dielectric layer.

(5) The method of (4) wherein a parting agent is disposed below the resin film.

(6) A composite substrate prepared by the method of (1), a functional thin film being to be formed on the resulting thick-film dielectric layer.

(7) An EL device comprising at least a light emitting layer and a transparent electrode on the composite substrate of (6).

FUNCTION AND RESULTS

According to the invention, a composite substrate of substrate/electrode/dielectric layer having a thick-film dielectric layer with a smooth surface can be prepared by a simple process of carrying out heat compression on an unfired thick-film dielectric layer by WIP.

When an EL device is prepared using the composite substrate having a smooth surface, a light emitting layer to lie thereon can be formed uniformly without giving rise to a delamination phenomenon. As a result, an EL device having improved light-emitting performance and reliability can be fabricated. The heat compression process is compliant with large surface area displays because of an eliminated need for polishing step which was necessary in the prior art, and reduces the manufacturing cost because of a reduced number of steps.

DESCRIPTION OF THE PREFERRED EMBODIMENT

In the method for preparing a composite substrate according to the invention, at least an electrode and a green dielectric layer according to a thick-film technique are formed on an electrically insulating substrate, thereby providing a composite substrate precursor, and the precursor is pressed by WIP process until the surface becomes flat and smooth, followed by firing to complete the composite substrate.

Figure 1:
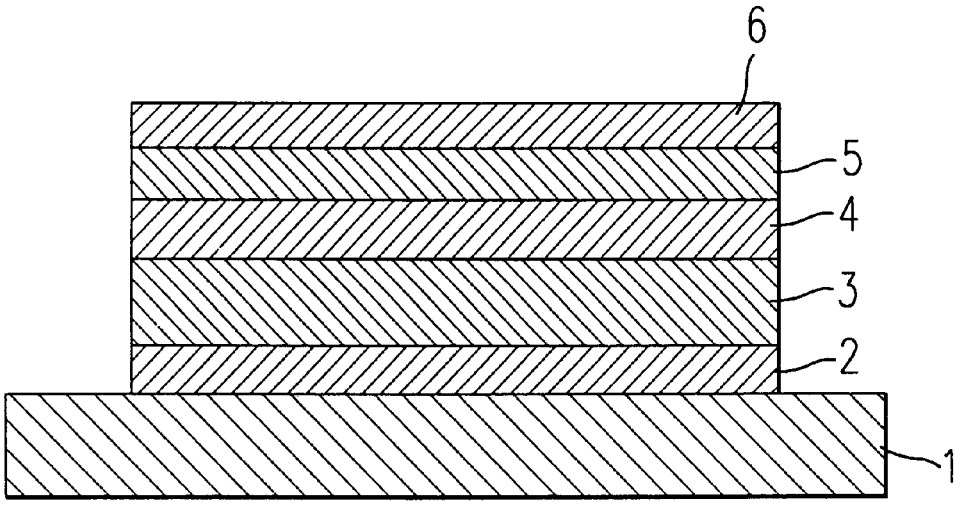
FIG. 1 is a cross-sectional view showing the basic construction of a composite substrate and an EL device according to the invention.
Figure 2:
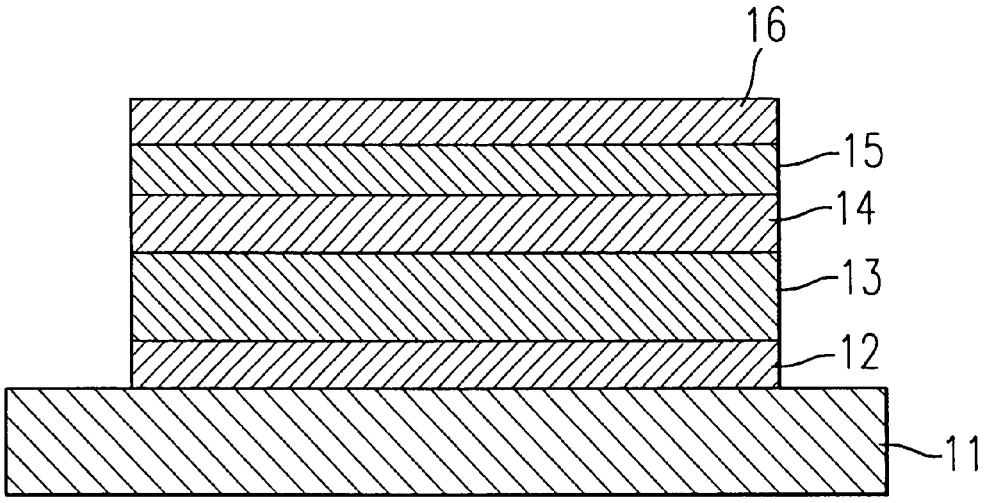
FIG. 2 PRIOR ART
FIG. 2 is a cross-sectional view showing the basic construction of a prior art EL device.

FIG. 1 illustrates the basic construction of a composite substrate to be prepared by the inventive method and an EL device using the same. The composite substrate to be prepared by the inventive method has a substrate 1, an electrode 2 formed thereon in a predetermined pattern, and a dielectric layer 3 formed thereon by a thick-film technique. The EL device using the composite substrate further has a light emitting layer 4 on the dielectric layer 3, preferably a thin-film insulating layer 5, and a transparent electrode 6 thereon.

The composite substrate precursor can be prepared by a conventional thick-film technique. More particularly, a paste, which is prepared by mixing a conductor powder such as Pd or Ag/Pd with a binder and a solvent, is printed in a predetermined pattern on an electrically insulating ceramic or glass substrate, for example, of $Al_2O_3$ or crystallized glass, typically by a screen printing technique.

The electrode layer is fired in air at about 800 to 900° C. for about 10 to 20 minutes, typically at 850° C. for 15 minutes, for example, in a belt kiln, thereby completing the electrode layer.

It is noted that the composition of the electrode layer is not limited to Pd or Ag/Pd. Any heat resisting electrode may be used and, for example, noble metals such as Au, Pt and Ir, and high-melting metals such as Ni, W, Mo, Nb and Ta and alloys thereof may be used. Also, the pattern may be formed by applying the paste over the entire surface, firing and etching by conventional photolithography, rather than directly printing a pattern by the screen printing technique. The process of forming the electrode layer is not limited to the printing process, and the electrode layer may be formed from the above-described material by a vacuum evaporation or sputtering technique.

Next, a dielectric paste, which is prepared by mixing a powdery dielectric material with optionally a binder and a solvent, is printed on the electrode by a screen printing technique. Alternatively, the dielectric paste is cast to form a green sheet, which is laid on the electrode.

The composite substrate precursor thus formed is subjected to heat compression treatment to smooth its surface. The process of heat compression treatment uses a warm isostatic press (abbreviated as WIP throughout the specification).

The WIP applies heat and pressure at a temperature ranging from 40° C. or the glass transition temperature (Tg) of a binder, if any, to 300° C. If the temperature exceeds the upper limit of 300° C., a sealing member can be degraded or damaged. Preferred conditions include a pressure of 500 to 6,000 kg/cm$^2$, especially 1,000 to 4,000 kg/cm$^2$ and a temperature from 40° C. or the glass transition temperature (Tg) of a binder to 300° C., more preferably about 60 to 150° C. and even more preferably about 70 to 120° C. Especially when a thermoplastic resin is used as a binder, the temperature should be at or above the glass transition temperature (Tg) of the binder, and preferably above Tg +several degrees. The compression time is about 1 to 30 minutes, as expressed by the holding time after the predetermined pressure is reached.

The pressure transmitting fluid for applying pressure may be water or silicone fluid although an aqueous pressure transmitting fluid is preferred for ease of handling.

Furthermore, to enhance the surface smoothing effect by heating, a thermoplastic one is advantageously used as the binder in preparing the dielectric paste.

A vacuum package is employed in the WIP to avoid contact of the composite substrate precursor with the pressure transmitting fluid, and a resin film bearing a parting agent thereon is preferably interposed between the vacuum package material and the green dielectric layer in order to prevent the green dielectric layer from sticking and joining to the vacuum package material.

Representative of the resin film are tetraacetyl cellulose (TAC), polyethylene terephthalate (PET), polyethylene naphthalate (PEN), syndiotactic polystyrene (SPS), polyphenylene sulfide (PPS), polycarbonate (PC), polyarylate (PAr), polysulfone (PSF), polyester sulfone (PES), polyether imide (PEI), tubular polyolefin, brominated phenoxy, and polyimide (PI), with the PET film and polyimide film being especially preferred.

On these films, a thin film of aluminum, nickel, stainless steel or the like may also be formed by an evaporation or plating technique. Since such a metal film has an elastic modulus about 100 times that of resin film, even a thin film is effective for improving the mechanical strength of resin film and also for enhancing the surface smoothing effect of heat compression treatment by WIP.

The vacuum package material is not critical as long as it prevents contact of the composite substrate with the pressure transmitting fluid and does not obstruct the function of WIP. Use may be made of any vacuum package material customarily used in WIP. Examples are polyurethane sheets and nylon-polyethylene sheets. The interior of the vacuum package material need not necessarily be vacuum as long as the vacuum package material is in intimate contact with the composite substrate.

As the parting agent, use may be made of silicone base materials, for example, dimethylsilicone base materials. A silicone resin coating is a layer for imparting parting properties to the film, and is formed by coating a solution containing a curable silicone resin, drying and curing. The technique of coating the silicone resin coating solution may be any of well-known techniques including reverse roll coating, gravure roll coating and air knife coating.

The green dielectric layer on the resulting composite substrate has a surface roughness Ra of preferably up to 0.5 $\mu$m. The surface roughness on this level can be readily accomplished using a vacuum package material of a resin film having a flat surface, or using a resin film having a flat surface to be interposed between the green dielectric layer and the package.

The conditions under which the green dielectric layer is fired may be determined as appropriate, depending on the type of the dielectric layer. Usually, conditions for binder burnout include an oxidizing atmosphere, 350 to 500° C. and about 10 minutes to 10 hours, and firing conditions after the binder burnout include about 750 to 1,200° C. A firing temperature below the range may result in insufficient consolidation whereas a temperature above the range may cause damages to the electrode layer. The temperature-holding time during firing is preferably from about 5 minutes to about 1 hour.

It is more effective to form, after firing, a dielectric such as PZT by a solution applying/firing technique such as a sol-gel technique for further smoothing the surface. Surface smoothing can be accomplished by a conventional sol-gel technique, although the preferred sol is formed by dissolving a metal compound in a diol: $HO(CH_2)_nOH$ such as propane diol as a solvent. Although a metal oxide is often used as the metal compound raw material in the preparation of a sol-gel solution, the metal alkoxide is susceptible to hydrolysis. Thus, when it is desired to prepare a high concentration solution, an acetyl acetonate compound or derivative thereof is preferably used in order to prevent precipitation of the raw material or solidification of the solution.

The smoothing layer preferably has a thickness of 0.1 to 5 $\mu$m, and especially at least 0.5 $\mu$m.

The substrate used herein is not critical as long as it is electrically insulating, does not contaminate the electrode layer and dielectric layer to be formed thereon, and maintains a predetermined strength.

Illustrative materials include ceramic substrates of alumina ($Al_2O_3$), quartz glass ($SiO_2$), magnesia (MgO), forsterite ($2MgO \cdot SiO_2$), steatite ($MgO \cdot SiO_2$), mullite ($3Al_2O_3 \cdot 2SiO_2$), beryllia (BeO), zirconia ($ZrO_2$), aluminum nitride (AlN), silicon nitride (SiN), and silicon carbide (SiC+BeO) as well as heat resistant glass substrate such as crystallized glass. Besides, Ba, Sr and Pb base perovskite materials may likewise be used and in this case, a composition of the same system as the dielectric layer may be used.

Of these, alumina substrates are especially preferred because of mechanical strength and heat resistance. Where a composition of the same system as the thick-film dielectric layer is used as the substrate material, better results are obtained because a bowing or stripping phenomenon caused by differential thermal expansion does not occur.

Alternatively, crystallized glass, heat resistant glass or the like is used as the substrate. Metal substrates treated with enamel to be insulating can also be used.

The material of which the dielectric layer is constructed is not critical. A variety of dielectric materials may be used. For example, high-permittivity dielectric materials such as perovskite type ferroelectric materials, i.e., titanate base compound oxides ($BaTiO_3$, PZT, etc.), composite perovskite type relaxor ferroelectric materials (PMN, PWN, PFW, etc.), tungsten bronze type ferroelectric materials (PBN, SBN, etc.) and composite materials thereof are especially suited for EL devices because a high permittivity is available.

When the dielectric paste is prepared, an organic binder may be used. The organic binder used herein is not critical and may be chosen from those materials commonly used as the binder for ceramic materials. Examples of the organic binder include ethyl cellulose, acrylic resins, and butyral resins, and examples of the solvent include $\alpha$-terpineol, butyl carbitol and kerosene. The contents of organic binder and solvent in the paste are not critical and may be as usual. For example, the content of organic binder is about 1 to 5 wt% and the content of solvent is about 10 to 50 wt%.

A choice of a thermoplastic resin among the above-described materials as the organic binder is desirable because the function of WIP is exerted more effectively. Acrylic and butyral resins are especially preferred. An exemplary acrylic resin is methyl methacrylate (trade name: Elvacite 2046 by E. I. Dupont, Tg =35° C.), and an exemplary butyral resin is available under the trade name of Eslek BMS from Sekisui Chemical Co., Ltd. Among others, acrylic resins are especially preferred.

In the dielectric layer-forming paste, various additives such as dispersants, plasticizers, and insulators are contained if necessary.

The thick-film dielectric layer has a resistivity of at least about $10^8$ $\Omega \cdot$cm, especially about $10^{10}$ to $10^{18}$ $\Omega \cdot$cm. A material having a relatively high permittivity as well is preferred. Its permittivity $\epsilon$ is preferably about 100 to 10,000. Its thickness is preferably up to 100 $\mu$m, more preferably 5 to 50 $\mu$m, and even more preferably 10 to 40 $\mu$m.

From the composite substrate of the invention, a thin-film EL device can be fabricated by forming thereon functional films including a light emitting layer, another insulating layer, and another electrode layer. In particular, a thin-film EL device having improved performance can be obtained using a high-permittivity material in the dielectric layer of the composite substrate according to the invention. Since the composite substrate of the invention is a sintered material, it is suited for use in a thin-film EL device which is fabricated by carrying out heat treatment subsequent to the formation of a functional film or light emitting layer.

To fabricate a thin-film EL device using the composite substrate of the invention, a light emitting layer, another insulating layer, and another electrode layer may be formed on the dielectric layer in the described order.

Exemplary materials for the light emitting layer include the materials described in monthly magazine Display, April 1998, Tanaka, "Technical Trend of Advanced Displays," pp. 1–10. Illustrative are ZnS and Mn/CdSSe as the red light emitting material, ZnS:TbOF, ZnS:Tb and ZnS:Tb as the green light emitting material, and SrS:Ce, (SrS:Ce/ZnS)n, $Ca_2Ga_2S_4$:Ce, and $Sr_2Ga_2S_4$:Ce as the blue light emitting material.

SrS:Ce/ZnS:Mn or the like is known as the material capable of emitting white light.

Among others, better results are obtained when the invention is applied to the EL device having a blue light emitting layer of SrS:Ce studied in International Display Workshop (IDW), '97, X. Wu, "Multicolor Thin-Film Ceramic Hybrid EL Displays," pp. 593–596.

The thickness of the light emitting layer is not critical. However, too thick a layer requires an increased drive voltage whereas too thin a layer results in a low emission efficiency. Illustratively, the light emitting layer is preferably about 100 to 2,000 nm thick, and preferably about 300 to 1,500 nm thick, although the thickness varies depending on the identity of the fluorescent material.

In forming the light emitting layer, any vapor phase deposition technique may be used. The preferred vapor phase deposition techniques include physical vapor deposition such as sputtering or evaporation, and chemical vapor deposition (CVD).

Also, as described in the above-referred IDW, when a light emitting layer of SrS:Ce is formed in a $H_2S$ atmosphere by an electron beam evaporation technique, the resulting light emitting layer can be of high purity.

Following the formation of the light emitting layer, heat treatment is preferably carried out. Heat treatment may be carried out after an electrode layer, an insulating layer, and a light emitting layer are sequentially deposited from the substrate side. Alternatively, heat treatment (cap annealing) may be carried out after an electrode layer, an insulating layer, a light emitting layer and an insulating layer are sequentially deposited from the substrate side or after an electrode layer is further formed thereon. Often, cap annealing is preferred. The temperature of heat treatment, though it depends on the identity of the light emitting material, is preferably about 300 to the sintering temperature, more preferably about 400 to 900° C., and the time is about 10 to 600 minutes, especially about 10 to 180 minutes. The atmosphere during the annealing treatment may be the air or an atmosphere of $N_2$, Ar or He. When heat treatment is carried out at a high temperature above 600° C, an inert gas atmosphere of $N_2$, Ar or $H_2$ is preferred.

The insulating layer (other insulating layer) formed on the light emitting layer preferably has a resistivity of at least about $10^8\Omega\cdot$cm, especially about $10^{10}$ to $10^{18}\Omega\cdot$cm. A material having a relatively high permittivity as well is preferred. Its permittivity $\epsilon$ is preferably about 3 to 1,000.

The materials of which the insulating layer is made include, for example, silicon oxide ($SiO_2$), silicon nitride (SiN), tantalum oxide ($Ta_2O_5$), strontium titanate ($SrTiO_3$), yttrium oxide ($Y_2O_3$), barium tianate ($BaTiO_3$), lead titanate ($PbTiO_3$), zirconia ($ZrO_2$), silicon oxynitride (SiON), alumina ($Al_2O_3$), lead niobate ($PbNb_2O_6$), PMN [$Pb(Mg_{1/3}Nb_{2/3})O_3$], etc.

The technique of forming the insulating layer is the same as described for the light emitting layer. The insulating layer preferably has a thickness of about 20 to 1,000 nm, especially about 50 to 500 nm.

The upper electrode layer (other electrode layer) which is optional is preferably a transparent electrode which is transmissive in the predetermined light emission wavelength range. Transparent electrodes of ZnO or ITO as mentioned above are preferably used.

Also the electrode may be a silicon-based one. The silicon electrode layer may be either polycrystalline silicon (p-Si) or amorphous silicon (a-Si), or even single crystal silicon if desired.

In addition to silicon as the main component, the electrode is doped with an impurity for imparting electric conductivity. Any dopant may be used as the impurity as long as it can impart the desired conductivity. Use may be made of dopants commonly used in the silicon semiconductor art. Exemplary dopants are B, P, As, Sb, Al and the like. Of these, B, P, As, Sb and Al are especially preferred. The preferred dopant concentration is about 0.001 to 5 at%.

In forming the electrode layer from these materials, any of conventional methods such as evaporation, sputtering, CVD, sol-gel and printing/firing methods may be used.

The electrode layer should preferably have a resistivity of up to 1 $\Omega\cdot$cm, especially about 0.003 to 0.1 $\Omega\cdot$cm in order to apply an effective electric field across the light emitting layer. The preferred thickness of the electrode layer is about 50 to 10,000 nm, more preferably about 100 to 5,000 nm, especially about 100 to 3,000 nm, though it depends on the identity of electrode material.

By following the above-described procedures, the composite substrate and the EL device can be constructed. The method of the invention omits an extra polishing step and simplifies the manufacturing process, achieving a substantial reduction of manufacturing cost. Large size displays can be easily manufactured.

Although the above-illustrated EL device has only one light emitting layer, the thin-film EL device of the invention is not limited to the illustrated construction. For example, a plurality of light emitting layers may be stacked in the thickness direction, or a plurality of light emitting layers (pixels) of different type are combined in a planar arrangement so as to define a matrix pattern.

Since the thin-film EL device of the invention uses the substrate material resulting from firing, even a light emitting layer capable of emitting blue light at a high luminance is readily available. Additionally, since the surface of the dielectric layer on which the light emitting layer lies is smooth and flat, a color display featuring high performance and fine definition can be constructed. The manufacturing process is relatively easy and the manufacturing cost can be kept low. Because of its efficient emission of blue light at a high luminance, the device can be combined as a white light emitting device with a color filter.

As the color filter film, any of color filters used in liquid crystal displays or the like may be employed. The characteristics of a color filter are adjusted to match with the light emitted by the EL device, thereby optimizing extraction efficiency and color purity.

It is also preferred to use a color filter capable of cutting external light of short wavelength which is otherwise absorbed by the EL device materials and fluorescence conversion layer, because the weather resistance and display contrast of the device are improved.

An optical thin film such as a dielectric multilayer film may be used instead of the color filter.

The fluorescence conversion filter film is to convert the color of light emission by absorbing electroluminescence and allowing the phosphor in the film to emit light. It is formed from three components: a binder, a fluorescent material, and a light absorbing material.

The fluorescent material used may basically have a high fluorescent quantum yield and desirably exhibits strong absorption in the electroluminescent wavelength region. In practice, laser dyes are appropriate. Use may be made of rhodamine compounds, perylene compounds, cyanine compounds, phthalocyanine compounds (including sub-phthalocyanines), naphthalimide compounds, fused ring hydrocarbon compounds, fused heterocyclic compounds, styryl compounds, and coumarin compounds.

The binder is selected from materials which do not cause extinction of fluorescence, preferably those materials which can be finely patterned by photolithography or printing technique.

The light absorbing material is used when the light absorption of the fluorescent material is short and may be omitted if unnecessary. The light absorbing material may also be selected from materials which do not cause extinction of fluorescence of the fluorescent material.

The thin-film EL device of the invention is generally operated by pulse or AC drive. The applied voltage is generally about 50 to 300 volts.

Although the thin-film EL device has been described as a representative application of the composite substrate, the application of the composite substrate of the invention is not limited thereto. It is applicable to a variety of electronic materials, for example, thin-film/thick-film hybrid high-frequency coil elements.

EXAMPLE

Examples are given below by way of illustration and not by way of limitation. The EL structure used in the Examples is constructed such that a light emitting layer, an upper insulating layer and an upper electrode were successively deposited on the surface of a dielectric layer of a composite substrate by thin-film techniques.

Example 1

A paste, which was prepared by mixing Ag—Pd powder with a binder and a solvent, was printed on a substrate of 99.5% $Al_2O_3$ in a stripe pattern including stripes of 1.5 mm wide and gaps of 1.5 mm, dried at 110° C. for several minutes, and fired at 850° C. for 15 minutes.

A dielectric paste was prepared by mixing $Pb(Mg_{1/3}Nb_{2/3})O_3$—$PbTiO_3$ powder raw material having a mean particle size of about 0.4 $\mu$m with 3 wt% of ethyl cellulose (trade name: N200 by Hercules Inc.) as a binder and $\alpha$-terpineol as a solvent. The dielectric paste was printed on the substrate having the electrode pattern printed and fired thereon and dried, and the printing and drying steps were repeated six times. The resulting green dielectric layer had a thickness of about 40 $\mu$m. Next, the entire structure was vacuum packed with polyethylene resin film and heat compressed by a WIP at a temperature of 85° C and a pressure of 4,000 kg/cm$^2$ for 3 minutes. Finally, the structure was fired in air at 900° C for 15 minutes. The thick-film dielectric layer as fired had a thickness of about 30 $\mu$m.

Example 2

In Example 1, the dielectric paste was prepared using 3.5 wt% of a thermoplastic acrylic resin (methyl methacrylate, trade name: Elvacite 2046 by E. I. Dupont, Tg =35° C.) as the binder, 35 wt% of methylene chloride as the solvent, and 2 wt% of hexyl phthalate as a plasticizer.

Example 3

When the composite substrate precursor having the green dielectric layer formed thereon was vacuum packed in Example 2, a PET film coated with a silicone base parting agent was interposed between the green dielectric layer and the vacuum package material in the form of polyethylene resin film.

Example 4

In Example 2, the dielectric paste was prepared using polymethacrylate (Tg =65° C.) as the binder.

Comparative Example 1

A sample was prepared as in Example 1 except that WIP was omitted.

Comparative Example 2

In Example 2, the WIP conditions were changed to a temperature of 20° C., a pressure of 4,000 kg/cm$^2$ and a time of 3 minutes.

In the foregoing Examples and Comparative Examples, the surface roughness of the dielectric layer was measured by a Talistep while moving a 0.8-mm probe at a speed of 0.1 mm/sec. To measure the electrical properties of the dielectric layer, an upper electrode was formed on the dielectric layer. The upper electrode was formed by printing the above-described electrode paste in a stripe pattern having stripes of 1.5 mm wide and gaps of 1.5 mm so as to extend normal to the electrode pattern on the substrate, drying and firing at 850° C. for 15 minutes.

Dielectric properties were measured using a LCR meter at a frequency of 1 kHz. Insulation resistance was determined by measuring a current flow after applying a voltage of 25 V for 15 seconds and holding for one minute. Breakdown voltage was the voltage value at which a current of at least 0.1 mA flowed when the voltage applied across the sample was increased at a rate of 100 V/sec. Measurement of surface roughness and electrical properties was made at three distinct positions on a single sample and an average thereof was reported as a measurement.

As to the electrical properties of the composite substrate of Example 3, it had a permittivity of about 5,000, a tan$\delta$ of 2.0%, a resistivity of $8\times10^{11}\Omega\cdot$cm, and a breakdown voltage of 14 V/$\mu$m.

For the manufacture of EL devices, a substrate was prepared by applying a sol-gel solution, which was prepared as described below, onto each of the dielectric substrates obtained in Examples 1 to 4 and Comparative Examples by a spin coating technique, firing at 700° C. for 15 minutes, and repeating the applying and firing steps several times until a sol-gel film of about 0.5 $\mu$m thick was built up on the dielectric substrate.

The sol-gel solution was prepared by heating and agitating 8.49 g of lead acetate trihydrate and 4.17 g of 1,3-propane diol for 2 hours until a clear solution was obtained. Separately, 3.70 g of a 70 wt% 1-propanol solution of zirconium n-propoxide and 1.58 g of acetylacetone were heated and agitated for 30 minutes in a dry nitrogen atmosphere, to which 3.41 g of a 75 wt% 2-propanol solution of titanium diisopropoxide bisacetyl acetonate and 2.32 g of 1,3-propane diol were added, followed by heating and agitating for 2 hours. These two solutions were mixed at 80° C., and heated and agitated for 2 hours in a dry nitrogen atmosphere, yielding a brown clear solution. By holding this solution at 130° C. for several minutes for thereby removing by-products and heating and agitating for a further 3 hours, a PZT solution was prepared.

On the thus fabricated substrate, with the composite substrate not having an upper electrode heated at 200° C., a ZnS phosphor thin film was deposited to a thickness of 0.7 $\mu$m by a sputtering technique using a Mn-doped ZnS target. This was heat treated in vacuum at 600° C. for 10 minutes. Thereafter, a $Si_3N_4$ thin film as the second insulating layer and an ITO thin film as the second electrode were successively formed by a sputtering technique, completing an EL device. Light emission was measured by extending electrodes from the print fired electrode and ITO transparent electrode in the resulting device structure and applying an electric field at a frequency of 1 kHz and a pulse width of 50 μs.

The results are shown in Table 1.

TABLE 1

| | | Surface roughness (μm) | | | | Emission luminance of |
|---|---|---|---|---|---|---|
| | | Before firing | | After firing | | EL device |
| Sample | WIP | Ra | Rmax | Ra | Rmax | (cd/m$^2$) |
| CE1 | No | 0.81 | 9.85 | 1.03 | 11.24 | 153 |
| E1 | Yes | 0.25 | 3.50 | 0.35 | 3.24 | 1940 |
| E2 | Yes | 0.14 | 2.02 | 0.27 | 2.99 | 3890 |
| E3 | Yes | 0.07 | 1.05 | 0.18 | 1.61 | 5430 |
| E4 | Yes | 0.16 | 2.15 | 0.30 | 3.05 | 3750 |
| CE2 | Yes | 0.32 | 4.80 | 0.41 | 5.12 | 820 |

The effectiveness of the invention is evident from Table 1.

BENEFITS OF THE INVENTION

There have been described a method for preparing a composite substrate which has minimized surface asperities on a dielectric layer, which are otherwise developed under the influence of an electrode layer, unevenness upon printing, and surface roughness inherent to thick-film dielectrics, which eliminates a need for a polishing step, which is easy to manufacture, and which is applicable to the fabrication of a thin-film light-emitting device of high display quality, as well as the resulting composite substrate and a thin-film EL device using the same.

What is claimed is:

1. A method for preparing a composite substrate, comprising the steps of:

forming at least an electrode and a green dielectric layer according to a thick-film technique on an electrically insulating substrate, thereby providing a composite substrate precursor, smoothing the surface of the precursor by WIP process, and firing to complete the composite substrate.

2. The method of claim 1 wherein the WIP process is effected at a temperature which is not lower than 40° C. or the glass transition temperature (Tg) of a binder in said green dielectric layer.

3. The method of claim 1 wherein said green dielectric layer uses a thermoplastic resin as a binder.

4. The method of claim 1 wherein during the heat compression step, a vacuum package is used to avoid contact of the composite substrate precursor with a pressure transmitting fluid, and a resin film is interposed between the vacuum package and the green dielectric layer.

5. The method of claim 4 wherein a parting agent is disposed below the resin film.

6. A composite substrate prepared by the method of claim 1, a functional thin film being to be formed on the resulting thick-film dielectric layer.

7. An EL device comprising at least a light emitting layer and a transparent electrode on the composite substrate of claim 6.

* * * * *